US010724332B2

(12) United States Patent
Henschel, Jr. et al.

(10) Patent No.: US 10,724,332 B2
(45) Date of Patent: Jul. 28, 2020

(54) LOW-POWER ELECTRIC SAFETY VALVE

(71) Applicant: CHEVRON U.S.A. INC., San Ramon, CA (US)

(72) Inventors: Robert C. Henschel, Jr., The Woodlands, TX (US); Samuel E. Herod, Conroe, TX (US); Paul R. Boriack, The Woodlands, TX (US); Shane W. Pfaff, Spring, TX (US); Thomas G. Hill, Jr., The Woodlands, TX (US); Jason C. Mailand, The Woodlands, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 223 days.

(21) Appl. No.: 15/856,834

(22) Filed: Dec. 28, 2017

(65) Prior Publication Data

US 2019/0203564 A1 Jul. 4, 2019

(51) Int. Cl.
*E21B 34/06* (2006.01)
*E21B 34/00* (2006.01)

(52) U.S. Cl.
CPC ..... *E21B 34/066* (2013.01); *E21B 2034/005* (2013.01)

(58) Field of Classification Search
CPC ..... E21B 34/066; E21B 2034/005
See application file for complete search history.

(56) References Cited

U.S. PATENT DOCUMENTS 4,002,202 A 1/1977 Huebsch et al.
4,407,329 A 10/1983 Huebsch et al.
4,566,534 A * 1/1986 Going, III ..... E21B 34/066 166/66.7
4,579,177 A * 4/1986 Going, III ..... E21B 34/06 137/629
4,585,067 A * 4/1986 Blizzard ..... E21B 34/102 166/319
4,649,993 A 3/1987 Going, III
4,749,043 A 6/1988 Rodenberger
4,796,708 A 1/1989 Lembcke
4,798,247 A 1/1989 Deaton et al.
4,886,114 A 12/1989 Perkins et al.
4,981,172 A 1/1991 Haerle
(Continued)

OTHER PUBLICATIONS

PCT Search Report & Written Opinion (PCT/US2018/014511), dated May 17, 2018.

*Primary Examiner* — Jennifer H Gay
(74) *Attorney, Agent, or Firm* — Gregory L. Porter; Hunton Andrews Kurth LLP

(57) ABSTRACT

A subsurface safety valve system for a wellbore is described. The system can include a tubular housing disposed within the wellbore having a cavity running in a longitudinal direction therethrough. The system can also include an electromagnetic device configured to receive electric power to create a magnetic field, and a flapper operative to open and close the cavity in response to the electric power received by the electromagnetic device. The flapper may open in response to the electric power exceeding a first electric power value and remain open in response to the electric power exceeding a second electric power value which is lower than the first electric power value.

19 Claims, 10 Drawing Sheets

(56) References Cited

U.S. PATENT DOCUMENTS

| | | | | |
|---|---|---|---|---|
| 4,981,173 | A * | 1/1991 | Perkins | E21B 34/066 166/66.7 |
| 5,070,595 | A * | 12/1991 | Perkins | E21B 34/066 166/66.7 |
| 5,070,944 | A * | 12/1991 | Hopper | E21B 34/066 166/66.7 |
| 5,257,663 | A | 11/1993 | Pringle et al. | |
| 5,293,551 | A | 3/1994 | Perkins et al. | |
| 6,253,843 | B1 * | 7/2001 | Rawson | E21B 34/066 166/66.7 |
| 6,269,874 | B1 * | 8/2001 | Rawson | E21B 34/066 166/53 |
| 6,283,217 | B1 * | 9/2001 | Deaton | E21B 34/101 166/324 |
| 6,325,153 | B1 * | 12/2001 | Harrell | E21B 34/066 166/386 |
| 6,433,991 | B1 * | 8/2002 | Deaton | E21B 23/00 361/191 |
| 6,619,388 | B2 | 9/2003 | Dietz et al. | |
| 8,857,522 | B2 | 10/2014 | Arrazola et al. | |
| 2006/0278395 | A1 * | 12/2006 | Kenison | E21B 21/10 166/312 |
| 2009/0090501 | A1 | 4/2009 | Hansen et al. | |
| 2009/0229814 | A1 * | 9/2009 | Going, III | E21B 34/066 166/66.4 |
| 2013/0105149 | A1 * | 5/2013 | Williamson, Jr. | E21B 34/06 166/250.01 |
| 2014/0009009 | A1 | 1/2014 | Deguchi et al. | |
| 2014/0262323 | A1 * | 9/2014 | Cox | E21B 34/14 166/373 |
| 2017/0002945 | A1 * | 1/2017 | Phelps | F16K 17/36 |
| 2019/0203564 | A1 * | 7/2019 | Henschel, Jr. | E21B 34/066 |

* cited by examiner

LOW-POWER ELECTRIC SAFETY VALVE

TECHNICAL FIELD

The present disclosure relates generally to surface-controlled subsurface safety valves (also called "SCSSVs") in a subterranean wellbore, and more specifically to electrically-powered surface-controlled subsurface safety valves in a subterranean wellbore.

BACKGROUND

In the production of oil and gas using a wellbore, safety valves are almost always required to be installed within the wellbore. The safety valves are designed to isolate the wellbore in the event of an operational condition that can result in damage at or near the surface. The operation of safety valves can become problematic in deep-water wells, where thousands of feet of hydrostatic pressure can build up even before entering the wellbore. Existing safety valves operate using hydraulics, Nitrogen, and/or magnets.

Some conventional hydraulic safety valves may have limited setting depths unless nitrogen balance pressures are used to offset the effects of high head pressures. The deeper a conventional safety valve is set, the higher the forces will be acting on the hydraulic piston. Eventually, the fail-safe power spring used to return the flow tube (and allow the flapper to close) may not be strong enough to lift the column of fluid acting on the hydraulic piston. Nitrogen has been used in the past to offset this effect. However, valves designed with nitrogen charge pressure may have the added disadvantage of operational variation with temperature and the potential of lost gas pressure.

Some conventional hydraulic safety valves also may have slow closure response times. When the hydraulic pressure is relieved on the safety valve (in an emergency condition), the time required to move the hydraulic fluid through the small diameter control line could be longer than desired. This presents operational, and sometimes regulatory, risks during operation.

Existing electric safety valves have significant power requirements to either drive motors, or hold solenoids in position to function properly. High power requirements generate significant heat which results in waste and may lead to premature component failure during the life of the well.

Therefore, there is a need for an improved safety valve system to solve the problem of hydrostatic pressure and depth limitations as well as minimize the power required to operate electric safety valves. By using an electric actuator and eliminating the need for a hydraulic control line, problems associated with depth and pressure can be mitigated. Slow response time is also mitigated because the safety valve is able to close almost instantaneously. Further, power required to hold open such safety valve system is reduced, in turn reducing component failure and power waste.

SUMMARY

One aspect of the present invention relates to a subsurface safety valve system for a wellbore. The safety valve system may include a tubular housing disposed within the wellbore having a cavity running in a longitudinal direction therethrough. The safety valve system may further include a power generation source which generates electric power, an electromagnetic device which receives the electric power generated by the power generation device to create a magnetic field, and a flapper operative to open and close the cavity in response to the electric power received by the electromagnetic device. The flapper may open in response to the electric power exceeding a first electric power value and may remain open in response to the electric power exceeding a second electric power value. The first electric power value may be greater than the second electric power value.

In one embodiment, the flapper may close in response to the electric power being less than or equal to the second electric power value.

In another embodiment, the electromagnetic device may comprise a coil.

In still another embodiment, the electromagnetic device may comprise a plurality of coils.

In still another embodiment the electromagnetic device may be in fluid isolation from the cavity.

In still another embodiment, the electromagnetic device may be isolated from the cavity by metal-to-metal static seals.

In still another embodiment, the safety valve system may further include a coil chamber containing the electromagnetic device. The coil chamber may be pressure balanced with the cavity.

In still another embodiment, the safety valve system may further include a coil chamber containing the electromagnetic device. The coil chamber may be pressure balanced with an annulus surrounding the tubular housing.

Another aspect of the present invention also relates to a safety valve system for a wellbore. The safety valve system may include a tubular housing disposed within the wellbore having a cavity running in a longitudinal direction therethrough. The safety valve system may also include a flow tube disposed within the housing and containing magnetic cores. The safety valve system may also include a power spring coupled to the flow tube so as to bias the flow tube toward an upper end of the tubular housing. The safety valve system may also include a power generation source which generates electric power. The safety valve system may also include an electromagnetic device offset in a longitudinal direction from the magnetic core. The electromagnetic device may be configured to receive the electric power generated by the power generation device to exert a magnetic force on the magnetic element toward a lower end of the tubular housing. The safety valve system may also include a flapper located within the tubular housing operative to open the cavity in response to displacement of the flow tube from a first position to a second position. The flow tube may be displaced from the first position to the second position in response to the electric power exceeding a first electric power value. The flow tube may remain displaced in the second position in response to the electric power exceeding a second electric power value. The first electric power value may be greater than the second electric power value.

In one embodiment, the safety valve system may include a retention mechanism which engages the flow tube to the tubular housing in response to the flow tube being displaced in the second position.

In another embodiment, the retention mechanism may include one or more retention balls configured to catch in a detent in the flow tube in response to the flow tube being displaced in the second position.

In still another embodiment, the electromagnetic device may be in fluid isolation in the coil chamber from the wellbore.

In still another embodiment, the flapper may be closed when the flow tube is in the first position.

In still another embodiment, the safety valve system may include a coil chamber containing the electromagnetic device, wherein the coil chamber is pressure balanced with an annulus surrounding the tubular housing.

In still another aspect of the present invention, a method of using the safety valve system as described herein may include a step of dithering the electric power such that the electric power does not fall below the second electric power value.

In another embodiment, the flow tube may be electrically vibrated while the cavity is open to allow the cavity to be closed.

In still another embodiment, the flow tube may be electrically vibrated while the cavity is closed to allow the cavity to be opened.

BRIEF DESCRIPTION OF THE DRAWINGS

The present invention will become more fully understood from the detailed description given below and from the accompanying drawings. The drawings are intended to disclose but a few possible examples of the present invention, and thus do not limit the present invention's scope.

DETAILED DESCRIPTION

The present invention generally relates to an improved electrically-powered, surface-controlled subsurface safety valve system for use in a subterranean wellbore. Preferred examples of the subsurface safety valve system described in detail below are useful specifically in the context of oil and gas drilling and wells. However, the examples described below may also be applicable to other high pressure fluidics applications.

Figure 1:
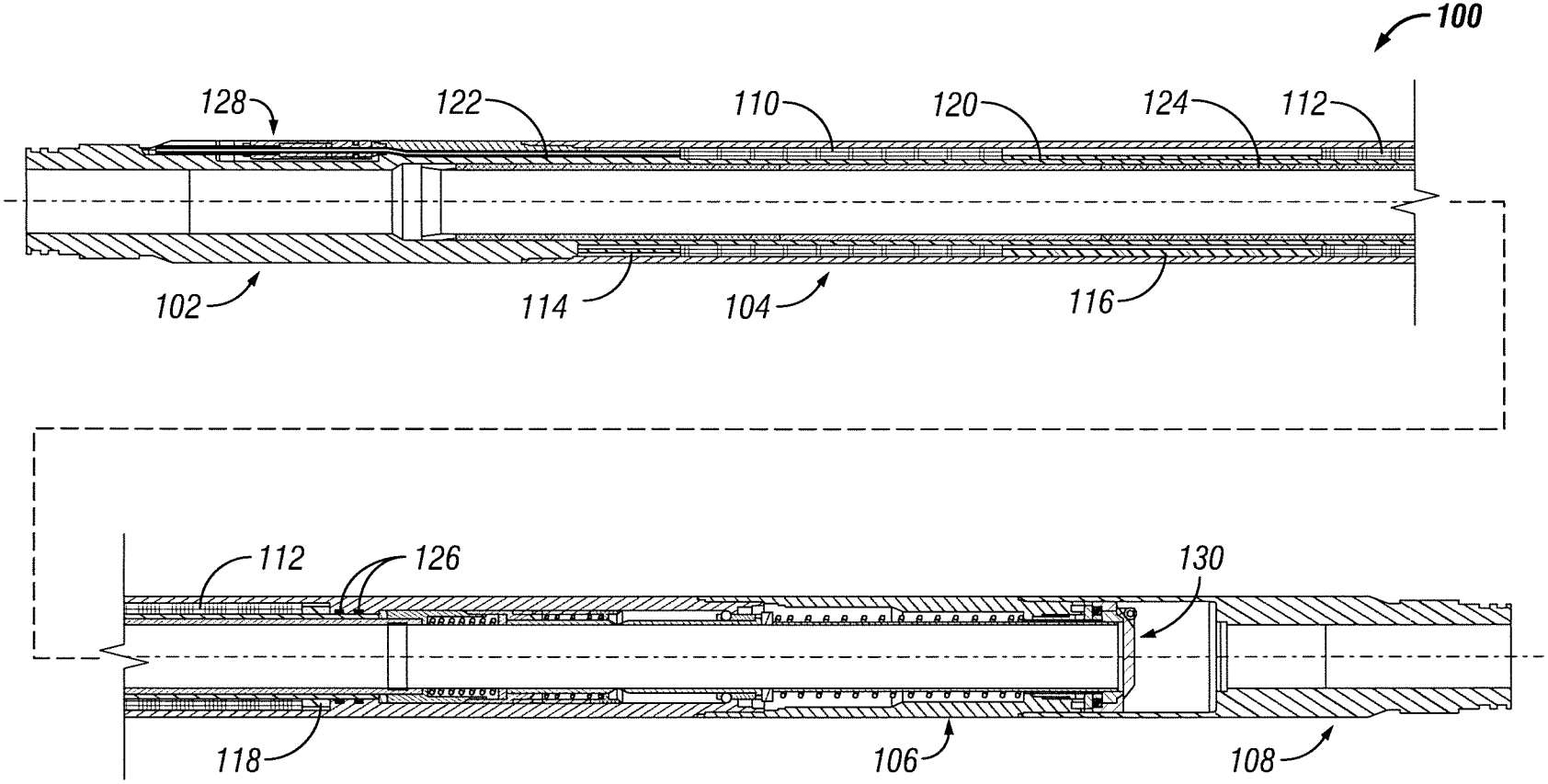
FIG. 1 shows a sectional view of a subsurface safety valve system in accordance with the present invention.

A sectional view of one example embodiment of a subsurface safety valve system in accordance with the present invention is shown in FIG. 1. The safety valve assembly 100 is configured to be connected to and integrated with downhole production tubing disposed in a subterranean wellbore. The safety valve assembly 100 includes a tubular housing which consists of an upper housing 102, an armature housing 104, a spring housing 106, and a lower housing 108. The upper housing 102 is mechanically coupled to the armature housing 104 which is mechanically coupled to the spring housing 106 which is mechanically coupled to the lower housing 108.

The armature housing 104 contains armatures which may reside in one or more coil chambers within the armature housing 104. In a particular embodiment as shown in FIG. 1, an upper armature 110 and a lower armature 112 are contained within the armature housing, but fewer or more armatures may be included as needed. The armatures 110 and 112 are preferably solenoids constructed of conductive cabling and electrically connected to electrical termination 128. The electrical termination 128 is connected to a power generation source which may be located at the surface of a wellbore.

The armature housing 104 may further contain armature spacers 114, 116, and 118 separating the armatures 110 and 112 from the ends of the armature housing 104 and from each other. The armatures 110 and 112 and the armature spacers 114, 116, and 118 are preferably tubular in shape or otherwise shaped to nest within the tubular armature housing 104. When the armatures 110 and 112 are energized with electrical power from the electrical termination 128, a magnetic flux circulates around each armature.

The example embodiment shown in FIG. 1 includes an upper armature 110 and a lower armature 112, but other numbers of armatures may be used. Multiple armatures may be connected to the power generation source in parallel such that each armature may be independently operated during for actuation of the valve in the event that any one or more armatures fail. When multiple armatures are used, the distance between them is preferably optimized to minimize the distance between them (thereby reducing manufacturing costs), while maximizing the magnetic force generated when the armatures are energized. The distance between armatures may be empirically determined and a variety of distances between armatures may be used depending on design criteria. As one example, the distance between armatures may be equal to the length of the armatures.

The length of the armatures themselves may vary as other dimensions, such as diameter of the safety valve assembly 100, vary. Preferably, the length of the armatures is three times the distance traveled by the flow tube when transitioning between an open and a closed state.

To prevent deformation of the structure, the coil chambers in which the armatures 110 and 112 reside are preferably pressure balanced to the flow tube. Pressure balancing may be achieved by a balance piston. The coil chambers may alternatively be pressure balanced to an annulus surrounding the tubular housing which includes armature housing 104.

The safety valve assembly 100 further includes a flapper 130 toward a lower end of the assembly. As used herein, the term upper end refers to an end of the safety valve assembly 100 furthest from the flapper 130 and the term upward refers to a direction pointing from the flapper 130 to the upper end. Also as used herein, the term lower end refers to an end of the safety valve assembly 100 closest to the flapper 130 and the term downward refers to a direction pointing from the upper end to the lower end.

Figure 2:
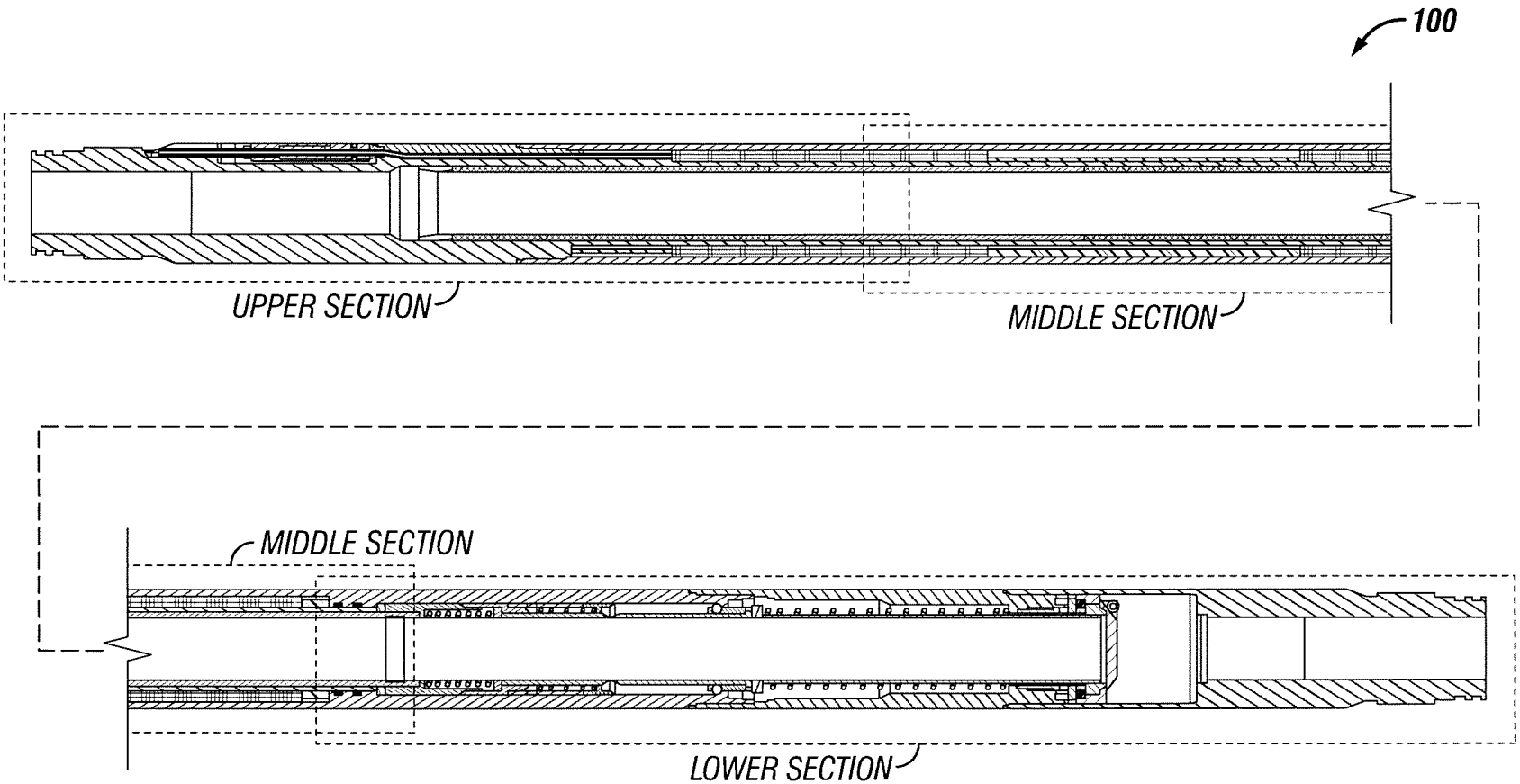
FIG. 2 shows a sectional view of a subsurface safety valve system in accordance with the present invention and identifies an upper section, a middle section, and a lower section thereof.

For purposes of more detailed diagrams, FIG. 2 depicts an upper section, a middle section, and a lower section of the safety valve assembly 100.

Figure 3:
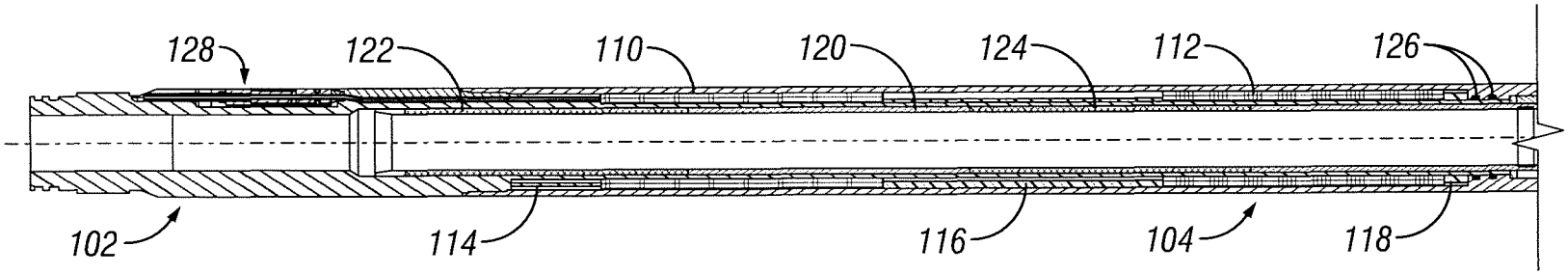
FIG. 3 shows a detailed sectional view of an upper section and a middle section of a subsurface safety valve system in accordance with the present invention.

A detailed sectional view of an upper section and a middle section of the safety valve assembly 100 is shown in FIG. 3. Within the upper housing 102 and the armature housing 104 is an upper flow tube 120. An outer surface of the upper flow tube 120 is preferably coincident or nearly coincident with inner surfaces of the upper housing 102 and the armature housing 104 and is capable of moving in a longitudinal direction with respect to the upper housing 102 and the armature housing 104. The upper flow tube 120 includes an upper core 122 and a lower core 124, each of which is formed from a magnetic material. When the safety valve system 100 is in a closed state, the cores 122 and 124 are offset toward the upper end of the safety valve assembly 100 in a longitudinal direction from the armatures 110 and 112, respectively.

The distance each core is offset toward the upper end of the safety valve assembly 100 in a longitudinal direction from its respective armature may be empirically determined and a variety of offset distances may be used depending on design criteria. As one example, each core may be offset toward the upper end of the safety valve assembly 100 in a longitudinal direction from its respective armature such that two-thirds of the length of the core protrudes from the armature.

Two cores 122 and 124 are shown in FIG. 3, but preferably the number of cores employed is the same as the number of armatures employed. Also preferably, cores 122 and 124 have a similar longitudinal length as the armatures 110 and 112 and further are spaced apart from each other a similar distance as armatures 110 and 112. Preferably, the cores 122 and 124 are tubular in shape or otherwise are formed in a similar shape as the upper flow tube 120.

The cores 122 and 124 are preferably formed from a material with high magnetic permeability and high magnetic saturation. Such a material may include "electrical iron," which may be sold under a variety of trade names.

Figure 4:
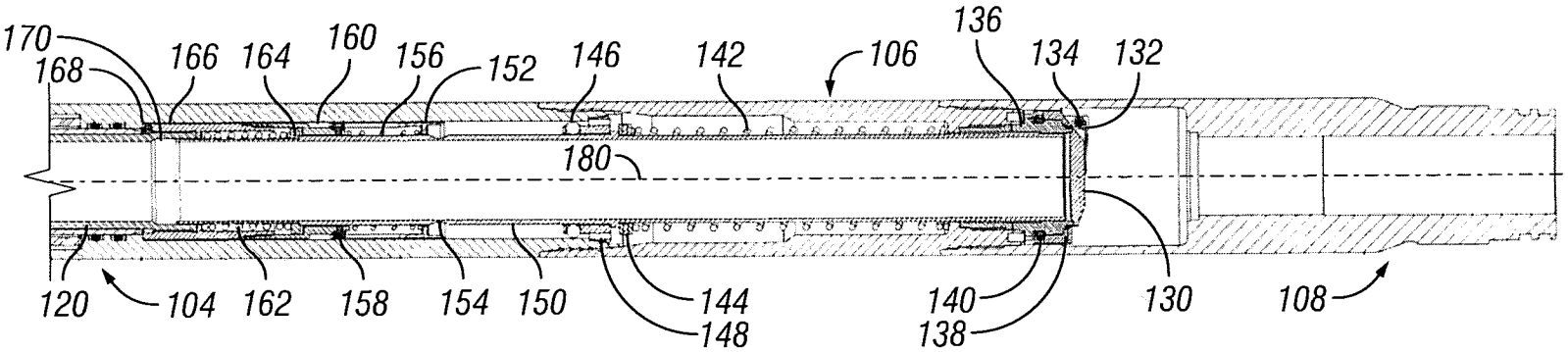
FIG. 4 shows a detailed sectional view of a lower section of a subsurface safety valve system in accordance with the present invention.

A detailed sectional view of a lower section of the safety valve assembly 100 is shown in FIG. 4. Flapper 130 is included toward the lower end of the safety valve assembly 100 and serves to open and close the flow tube. Flapper 130 rotates about flapper pin 134 which is oriented in a direction orthogonal to the longitudinal direction of the safety valve assembly 100. Flapper 130 is biased in a closed position by a flapper spring 132 which may be connected to the flapper pin 134. A hard seat 136 and a soft seat 138 collectively define a surface against which the flapper 130 rests in a closed position. The hard seat 136 and soft seat 138 may be fixed to either the spring housing 106 or the lower housing 108 by set screws 140, or by another means suitable for retaining the seats 136 and 138 in position with respect to the tubular housing.

A lower flow tube 150 is disposed within the armature housing 104 and the spring housing 106. Lower flow tube 150 may be nested within a receiving end 170 of the upper flow tube 120. Together, the lower flow tube 150 and the upper flow tube 120 define a channel 180 through which oil or gas (or other product) is transported. The channel is opened or closed by the flapper 130.

The lower flow tube 150 is biased toward an upper end of the safety valve assembly 100 by a power spring 142. Power spring 142 is preferably located along an outside surface of the lower flow tube 150 and within the spring housing 106. Power spring 142 may abut a shouldered edge of spring housing 106 at one axial end and spring spacer 144 on its other axial end, the spring spacer 144 being fixed to the lower flow tube 150.

A balance spring 162 urges the lower flow tube 150 and the upper flow tube 120 in opposite directions; the lower flow tube 150 being urged downward. The balance spring 162 is preferably located along an outside surface of the lower flow tube 150 and within the spring housing 106. The balance spring 162 is oriented between a flow tube adapter 166 at one axial end and a spring ring 164 at its other axial end, the spring ring 164 being fixed to the lower flow tube 150. The flow tube adapter 166 may be fixed at one end to the upper flow tube 120 by set screws 168 or by another suitable fixing mechanism. The flow tube adapter 166 is coupled at its other end to a catch coupler 160 which is part of a ball catch mechanism.

The ball catch mechanism consists of the catch coupler 160 to which ball catch sleeve 152 is attached via guide screws 158, or another suitable mechanism allowing longitudinal displacement of the ball catch sleeve 152 relative to the catch coupler 160. A catch spring 156 is oriented between the catch coupler 160 and ball catch sleeve 152 so as to urge them in opposite directions. The ball catch mechanism further includes retention balls 146 which are seated within ball cage 148 which is in turn fixed to the lower flow tube 150. The retention balls 146 may freely rotate within the ball cage 148 and roll along an inner surface of the armature housing 104, but may not be displaced relative to the ball cage 148 or the lower flow tube 150.

Figure 5A:
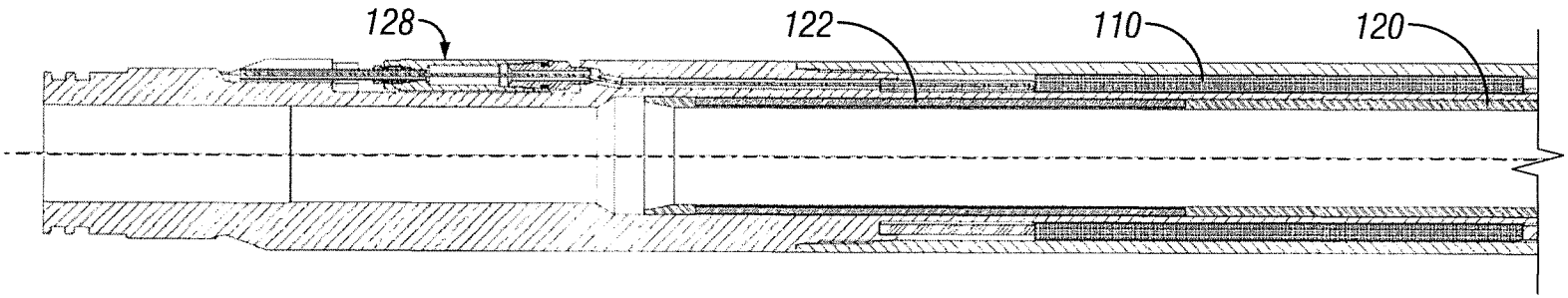
FIGS. 5A-5C show a detailed sectional view of an upper section, a middle section, and a lower section of a subsurface safety valve system, respectively, in a closed state in accordance with the present invention.
Figure 5B:
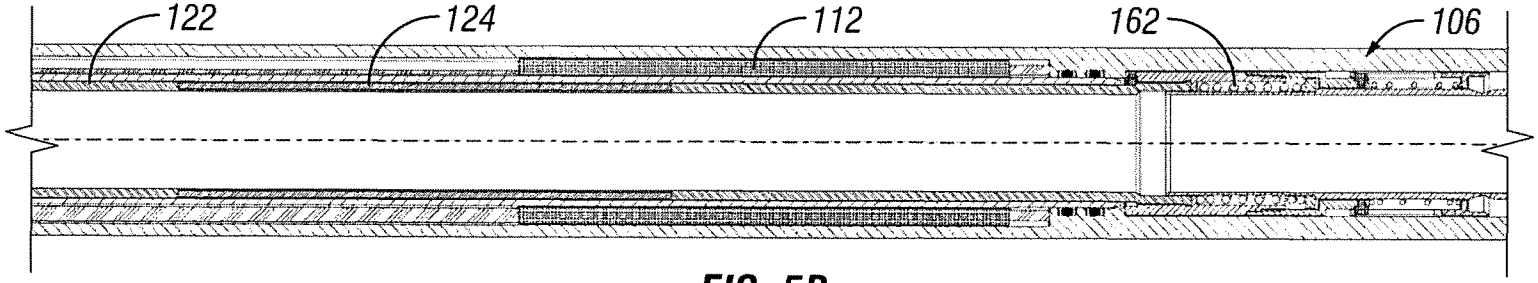
Figure 5C:
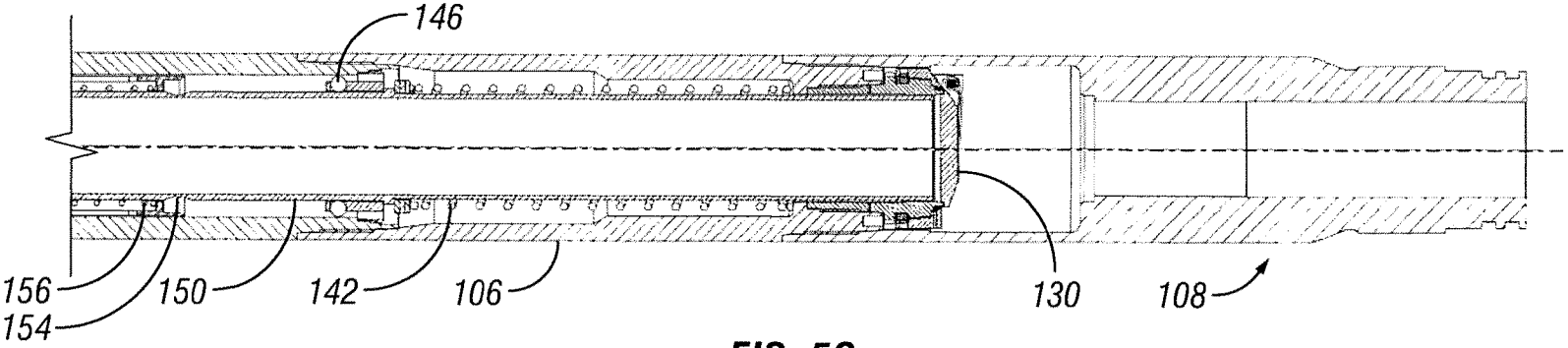

To illustrate basic functionality of the safety valve assembly 100, FIGS. 5A-C depict the assembly in a closed state. FIG. 5A shows an upper section of the assembly in a closed state, FIG. 5B shows a middle section of the assembly in a closed state, and FIG. 5C shows a lower section of the assembly in a closed state. In FIGS. 5A-C, the upper flow tube 120 is positioned toward the upper end of the assembly such that cores 122 and 124 are offset in an upward direction from the armatures 110 and 112. The lower flow tube 150 is likewise positioned at its most upward position such that power spring 142 is not compressed and a lower end of the flow tube 150 is not in contact with the flapper 130.

Figure 6A:
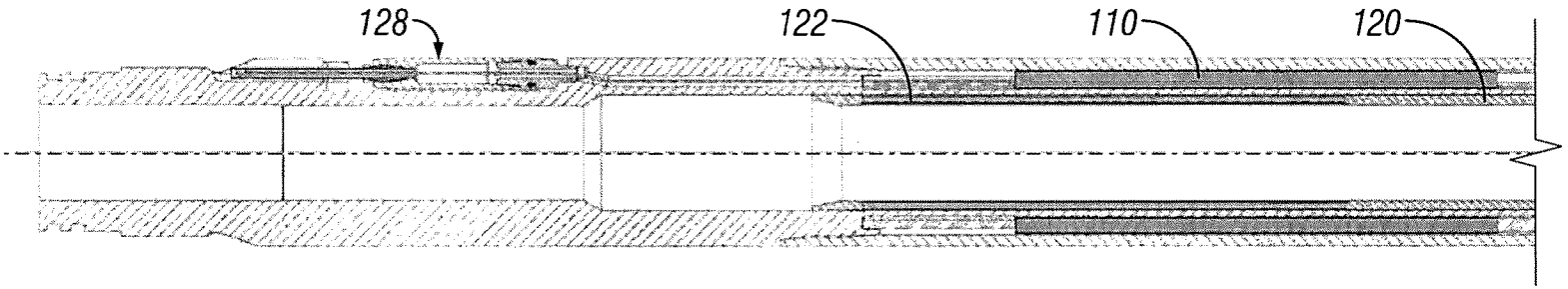
FIGS. 6A-6C show a detailed sectional view of an upper section, a middle section, and a lower section of a subsurface safety valve, respectively, in an open state in accordance with the present invention.
Figure 6B:
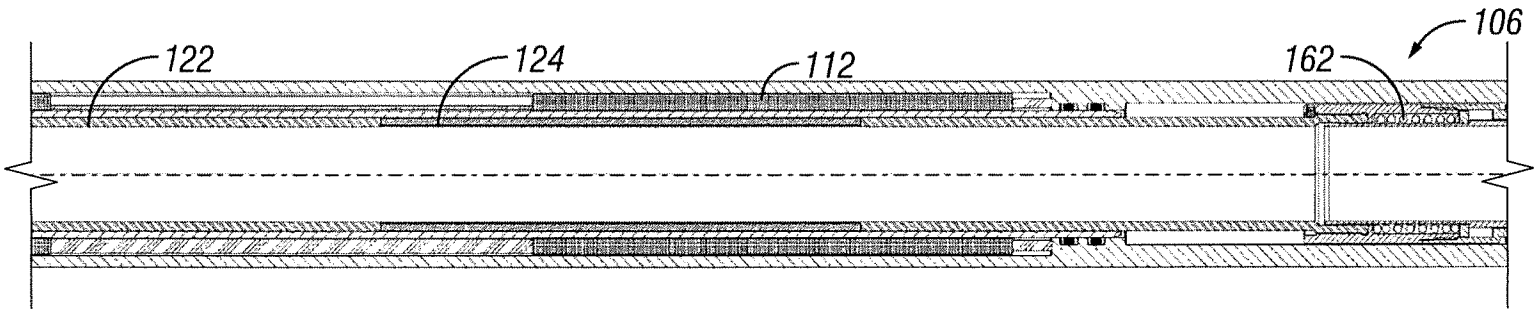
Figure 6C:
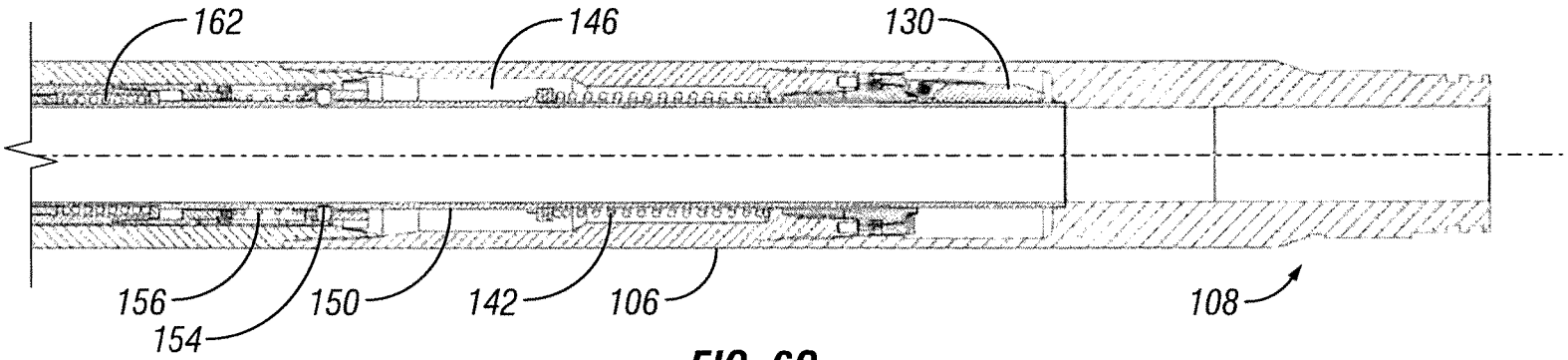

In comparison, FIGS. 6A-C depict the assembly in an open state. FIG. 6A shows an upper section of the assembly in an open state, FIG. 6B shows a middle section of the assembly in an open state, and FIG. 6C shows a lower section of the assembly in an open state. In FIG. 6-C, electric power is supplied to the armatures 110 and 112 such that a magnetic force is applied to cores 122 and 124 in a downward direction. As a result of the magnetic force, the upper flow tube 120 is positioned toward the lower end of the assembly such that cores 122 and 124 are more closely aligned with the armatures 110 and 112. The lower flow tube 150 is likewise positioned toward the lower end of the assembly such that a lower end of the flow tube 150 forces the flapper 130 into a downward position.

Actuation of movement of the upper flow tube 120 and the lower flow tube 150, and consequently opening/closing of the flapper 130 using electrical power will be described with reference to FIGS. 7-12 which show various states of a lower section of the assembly.

Figure 7:
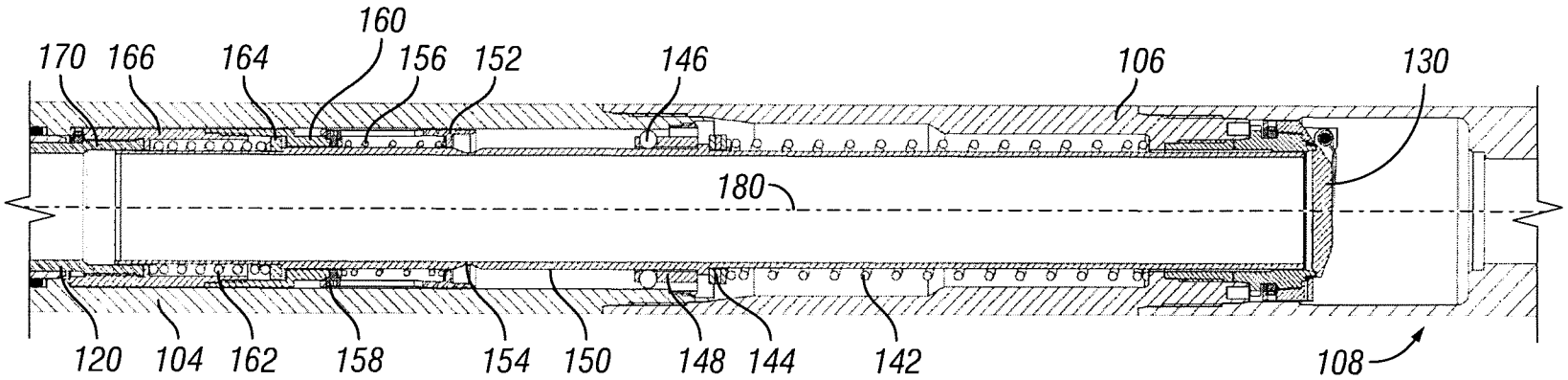
FIG. 7 shows a detailed sectional view of a lower section of a subsurface safety valve system in accordance with the present invention in a closed state.

In FIG. 7, no electric power is supplied to the armatures. When no electricity is supplied to the armatures, no magnetic force is applied to the cores and therefore the only force acting on the upper flow tube 120 and the lower flow tube 150 in the downward direction is gravity. Power spring 142 exerts a sufficient upward force on the lower flow tube 150 to counteract the force of gravity and prevent the lower flow tube 150 from forcing open flapper 130.

Figure 8:
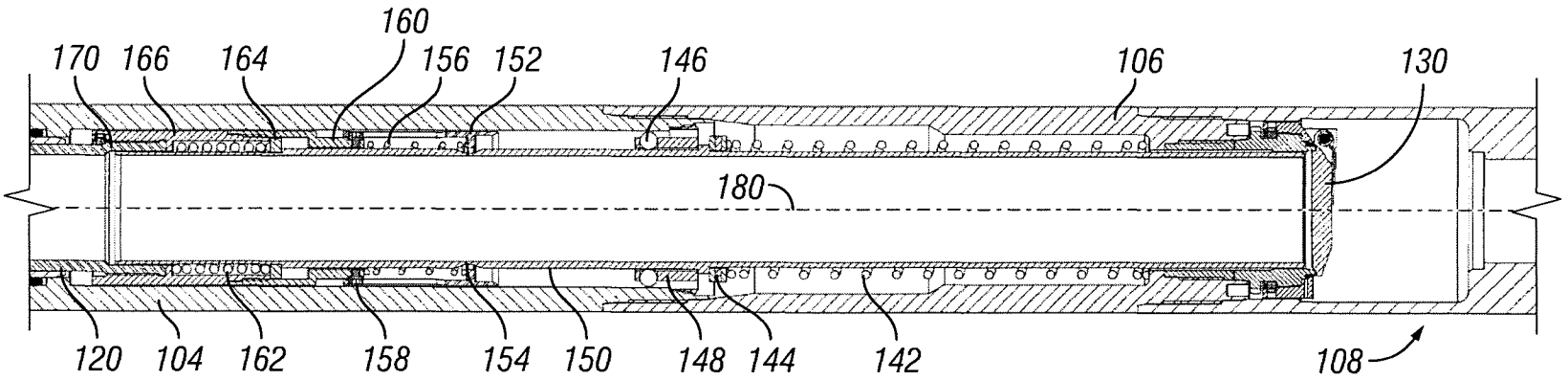
FIG. 8 shows a detailed sectional view of a lower section of a subsurface safety valve system in accordance with the present invention wherein the balance spring is compressed.

In FIG. 8, electric power is supplied to the armatures (not pictured) to create a magnetic field which exerts a magnetic force on the magnetic cores (not pictured) in a downward direction. The magnetic force acting on the cores is sufficient to move the upper flow tube 120 in a longitudinal direction downward so as to compress balance spring 162. In this state, an upper end of lower flow tube 150 is inserted further into the receiving end 170 of the upper flow tube 120. The receiving end 170 also urges flow tube adapter 166 toward a lower end of the assembly, which in turn urges catch coupler 160 and ball catch sleeve 152 toward a lower end of the assembly. Ball catch sleeve 152 is displaced downward relative to the lower flow tube 150 such that a stopper on the ball catch sleeve 152 is oriented adjacent to detent 154 in the lower flow tube 150.

Figure 9:
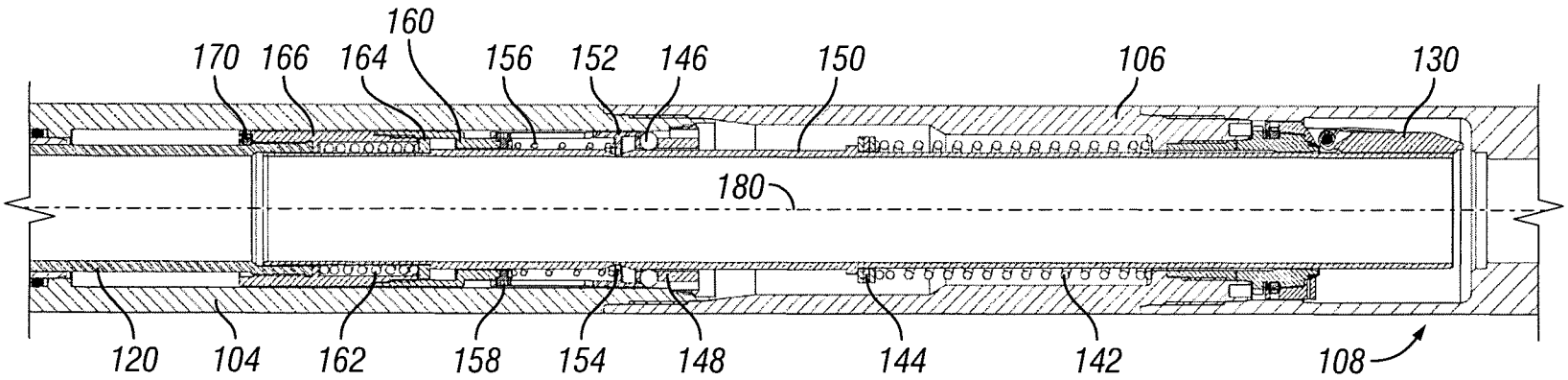
FIG. 9 shows a detailed sectional view of a lower section of a subsurface safety valve system in accordance with the present invention wherein the flapper is open.

In FIG. 9, the electric power continues to be supplied to the armatures (not pictured). With balance spring 162 compressed, the magnetic force acting on the cores is sufficient to subsequently compress the power spring 142 such that lower flow tube 150 is urged toward the lower end of the assembly well beyond a plane defined by the flapper 130 when the flapper 130 is in a closed position. Consequently, the lower flow tube 150 forces the flapper 130 open. When the lower flow tube 150 is in this position, an outer flange of ball catch sleeve 152 comes into contact with retention balls 146.

Figure 10:
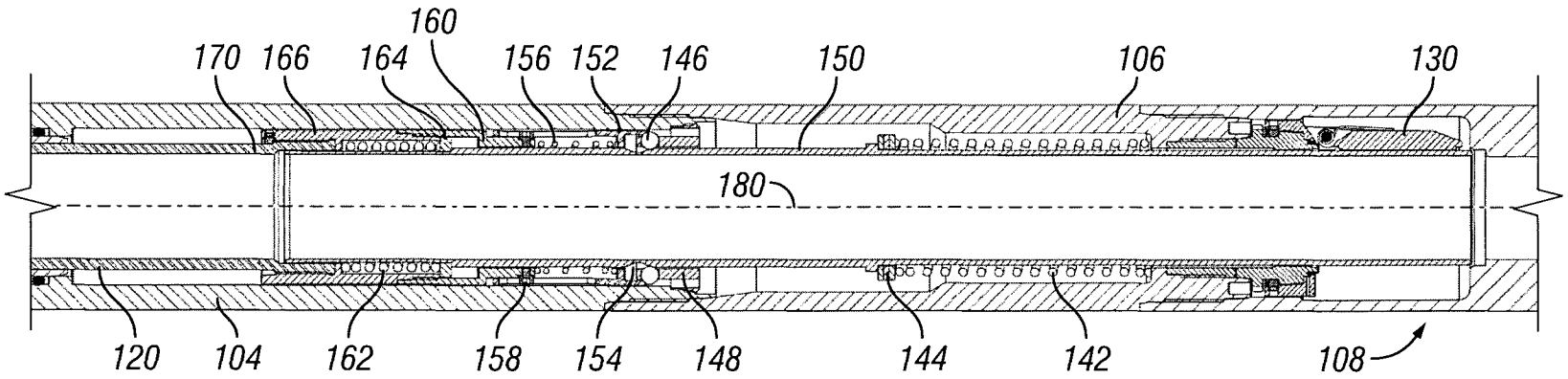
FIG. 10 shows a detailed sectional view of a lower section of a subsurface safety valve system in accordance with the present invention wherein the catch spring is compressed.

In FIG. 10, the electric power continues to be supplied to the armatures (not pictured). As a result, the upper flow tube 120 urges the lower flow tube 150 further toward the lower end of the assembly, compressing the power spring 142 further. The upper flow tube 120 also urges the flow tube adapter 166 downward, which in turn urges the catch coupler 160 downward. The retention balls 146 which cannot move in a longitudinal direction relative to the tubular housing exert a force on an outer flange of the ball catch sleeve 152 in the upward direction. Force exerted by the retention balls 146 in the upward direction urges the ball catch sleeve 152 in an upward direction, compressing the catch spring 156.

Figure 11:
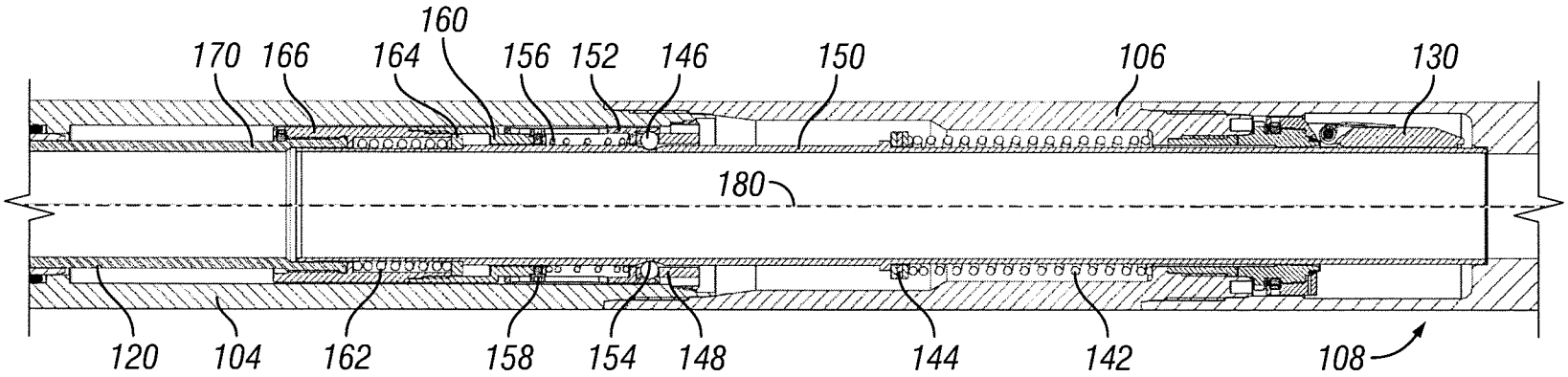
FIG. 11 shows a detailed sectional view of a lower section of a subsurface safety valve system in accordance with the present invention wherein the retention balls are seated in the flow tube detent.

In FIG. 11, the electric power continues to be supplied to the armatures (not pictured). As a result, the upper flow tube 120 urges the lower flow tube 150 to a position furthest toward the lower end of the assembly, compressing the power spring 142 further. In this position, the detent 154 of the lower flow tube 150 is aligned with the retention balls 146. The detent 154 allows the retention balls 146 to move radially toward the channel 180. The movement of the retention balls 146 creates a clearance between the retention balls 146 and the tubular housing such that the ball catch sleeve 152 is urged by the catch spring 156 downward and the outer flange of the ball catch sleeve 152 covers the retention balls 146.

When the ball catch sleeve 152 covers the retention balls 146 sitting in the detent 154, the lower flow tube 150 is prevented from moving longitudinally. The upward force of the power spring 142 acting on the lower flow tube 150 can thus be fully, or at least substantially counteracted by a downward normal force of the retention balls 146 acting on the surface of the detent 154 in lower flow tube 150. Accordingly, the electrical power supplied to the armatures to generate a magnetic force acting on the cores in a downward direction may be reduced while maintaining the open condition of the flapper 130. To maintain the flapper 130 in an open position with the retention balls 146 covered in the detent 154, the electric power supplied to the armatures need only be sufficient to generate a magnetic force to maintain the balance spring 162 in a compressed state such that the ball catch sleeve 152 continues to cover the retention balls 146. When the ball catch sleeve 152 covers the retention balls 146, the electrical power supplied to the armatures need not counteract the upward force of the power spring 142 to keep lower flow tube 150 in a downward-most position and the flapper 130 open.

Figure 12:
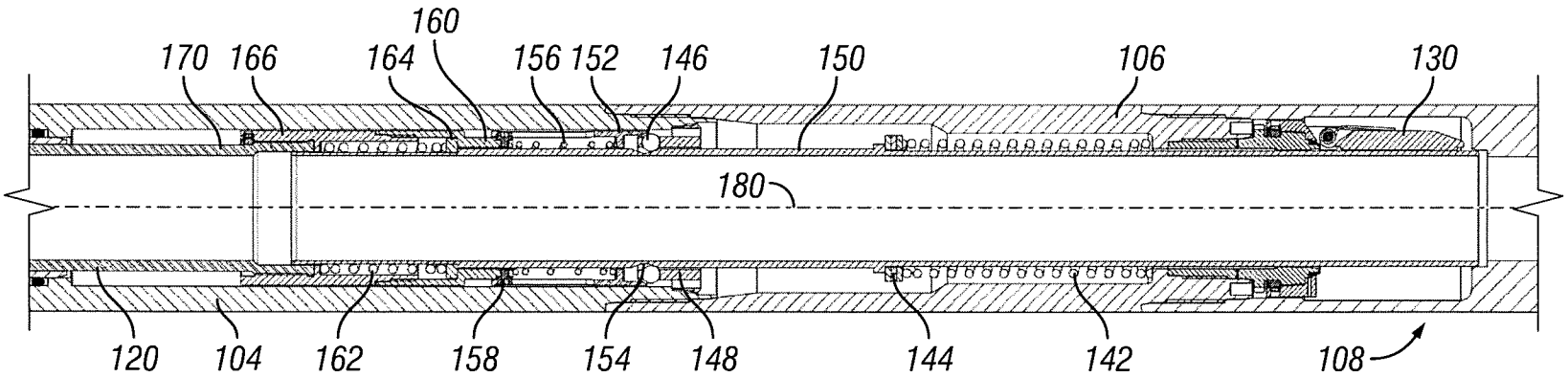
FIG. 12 shows a detailed sectional view of a lower section of a subsurface safety valve system in accordance with the present invention wherein the retention balls are released from the flow tube detent.

In FIG. 12, the electric power supplied to the armatures (not shown) is reduced such that the magnetic force exerted on the cores in a downward direction is insufficient to compress the balance spring 162. As a result, the balance spring 162 pushes the flow tube adapter 166 upward. The flow tube adapter 166 is coupled to the catch coupler 160 which is in turn coupled to the ball catch sleeve 152 via guide screws 158. The ball catch sleeve 152 is directed upward relative to the lower flow tube 150, uncovering the retention balls 146. When the retention balls 146 are uncovered, they no longer apply a downward force on the lower flow tube 150 sufficient to counteract the upward force applied by the power spring 142 to the lower flow tube 150 and the power spring 142 drives the lower flow tube 150 upward. When a lower end of the lower flow tube 150 clears a plane defined by the flapper 130 in its closed position, the flapper 130 closes, sealing the channel 180. When the flapper 130 closes, the safety valve assembly 100 returns to the state shown in FIG. 7.

An example embodiment as described above uses retention balls 146 to lock the lower flow tube 150 to the tubular housing, but the invention is not limited to embodiments employing retention balls as described above and as shown. Alternate embodiments may use dogs in lieu of balls and may further employ solenoids to temporarily lock the balls or dogs to the flow tube. Alternatively, other mechanisms may be used to reduce the power required to hold open the safety valve, such as a mechanism which locks the flow tube upon rotation once the flapper is opened.

Figure 13A:
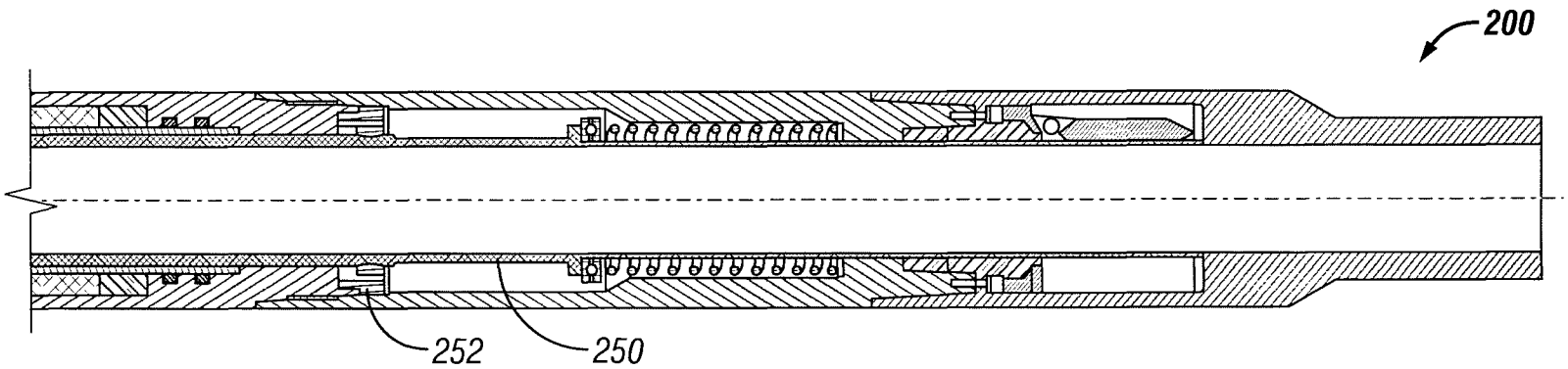
FIGS. 13A-13B show a detailed sectional view of a subsurface safety valve system with a radial collet mechanism.
Figure 13B:
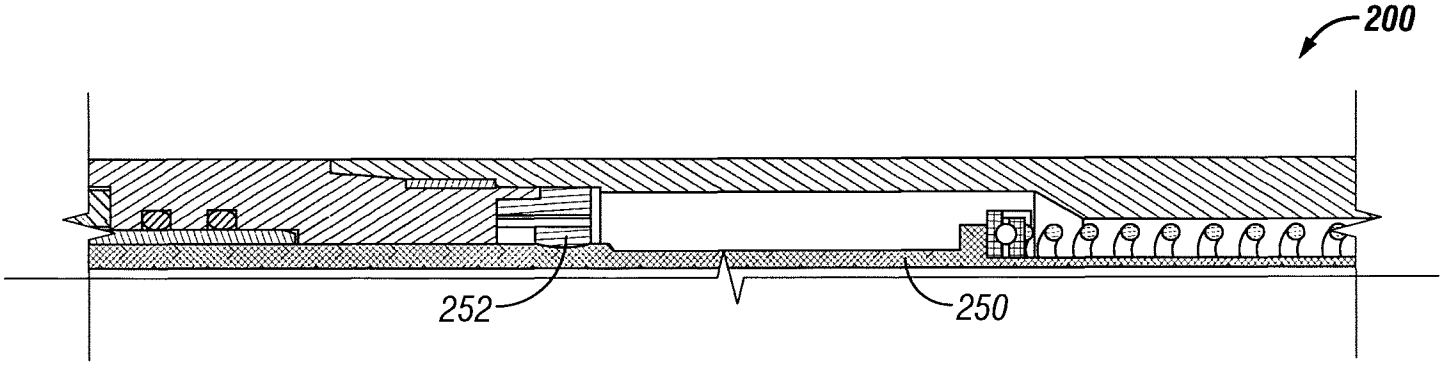

For example, in another embodiment, a radial collet mechanism may be used. FIG. 13A shows a safety valve assembly 200 similar to the safety valve assembly described above. In safety valve assembly 200, radial collet 252 is used to lock the lower flow tube 250 to the tubular housing. FIG. 13B shows the radial collet 252 of safety valve assembly 200 in greater detail.

Figure 14:
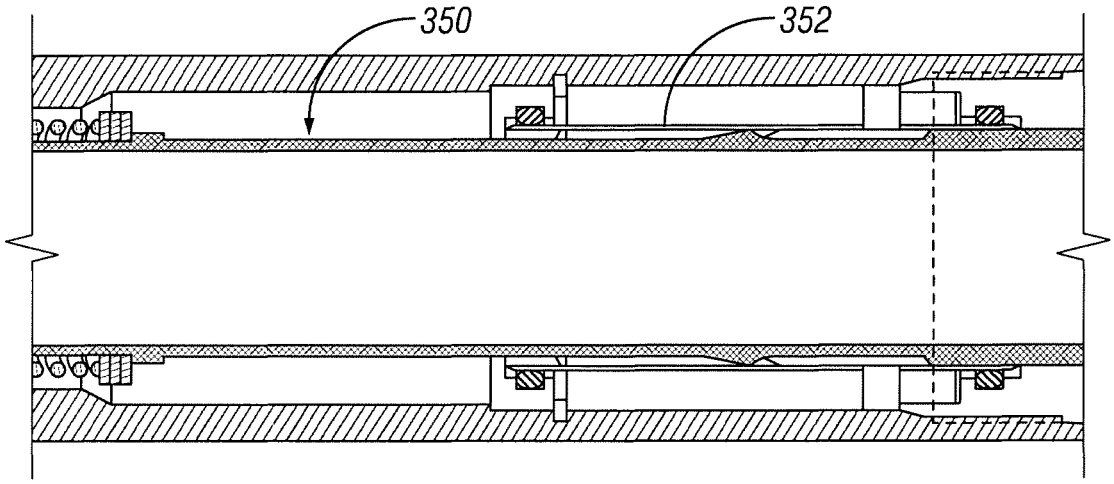
FIG. 14 shows a detailed sectional view of a subsurface safety valve system with a longitudinal collet mechanism.

As another example, in another embodiment, a longitudinal collet mechanism may be used. FIG. 14 shows a safety valve assembly 300 similar to the safety valve assemblies described above. In safety valve assembly 300, longitudinal collet 352 is used to lock the lower flow tube 350 to the tubular housing.

A method of using the safety valve assembly above may include dithering the electrical power supplied to the armatures at values sufficient to move the flow tube slightly against the compression force of the springs. After long periods without a change in state, the flow tube in the safety valve assembly may stick to the tubular housing as a result of the product travelling within the flow tube. By dithering the electric power provided to the armatures at values below the electric power required to open the flapper, a vibration of the flow tube with respect to the surrounding tubular housing occurs. The result of the vibration is to enable motion when substances or conditions may cause the flow tube to stick in either the open or closed position. Dithering may be used when the safety valve assembly is in an open state, a closed state, is opening, or is closing. Dithering may reduce the electrical power necessary to operate the safety valve.

The advantages of the embodiment described above are several. A major advantage is that the electrical power required to hold open the flapper may be reduced substantially. Electric power alone is used initially to generate sufficient magnetic force acting on the flow tube to open the flapper. However, once the flapper is opened, the electrically-generated force required to maintain the flapper in an open position is supplemented by a simple mechanical force applied by the retention balls, or the like, which requires no additional power input. The electric power supplied to the armatures can thus be reduced while maintaining the flapper in an open position, reducing heat generated in the system as well as power consumed.

Another advantage provided by the invention is that the design is simple and less susceptible to failure than, for instance, a safety valve employing an electric motor to drive flow tubes and open a flapper. Because moving parts are minimized, fewer components are susceptible to wear. The use of electrical actuation also mitigates the delays and limitations associated with hydraulically operated safety valves. Interrupting the power transmitted to the armatures causes the safety valve to close virtually instantaneously, whereas a hydraulically-operated safety valve located at a significant depth would remain open for a longer period of time before the column of hydraulic fluid could be lifted. Furthermore, the implementation of multiple armature and core pairs as described above provides multiple redundant and independent actuation systems. If one armature were to fail, the one or more other armatures could continue to be used to actuate the safety valve.

Still another advantage of the invention is that requires only metal-to-metal static seals. Conventional safety valves of either hydraulic or electric type utilize dynamic seals, elastomeric seals, or thermoplastic seals to accommodate a greater number of moving parts. Such seals are either exposed to corrosive materials in the production tubing or are subjected to degradation from reciprocation. Further, they are frequently made from less durable materials than metals. The elimination of these types of seals in exchange for metal-to-metal static seals in the present invention serve to extend the useful life of the safety valve.

While a particular embodiment has been described, other embodiments are plausible. It should be understood that the foregoing description of an improved subsurface safety valve system is not intended to be limiting, and any number of modifications, combinations, and alternatives to the example described above may be employed.

The example described herein is merely illustrative, as numerous other embodiments may be implemented without departing from the spirit and scope of the present invention. Moreover, while certain features of the invention may be described above only in the context of certain examples or configurations, these features may be exchanged, added, and removed from and between various embodiments or configurations while remaining within the scope of the invention.

We claim:

1. A subsurface safety valve system for a wellbore comprising:

a tubular housing disposed within the wellbore wherein the tubular housing has a cavity running in a longitudinal direction therethrough;

an electromagnetic device being configured to receive electric power to create a magnetic field;

a coil chamber containing the electromagnetic device, wherein the coil chamber is pressure balanced with the cavity; and a flapper operative to open and close the cavity in response to the electric power received by the electromagnetic device, wherein:

the flapper opens in response to the electric power exceeding a first electric power value;

the flapper remains open in response to the electric power exceeding a second electric power value; and the first electric power value is greater than the second electric power value, wherein the coil chamber is pressure balanced with an annulus surrounding the tubular housing.

2. The subsurface safety valve system for a wellbore of claim 1, wherein the flapper closes in response to the electric power being less than or equal to the second electric power value.

3. The subsurface safety valve system for a wellbore of claim 1, wherein the electromagnetic device comprises a coil.

4. The subsurface safety valve system for a wellbore of claim 1, wherein the electromagnetic device comprises a plurality of coils.

5. The subsurface safety valve system for a wellbore of claim 1, wherein the electromagnetic device is in fluid isolation from the cavity.

6. The subsurface safety valve system for a wellbore of claim 5, wherein the electromagnetic device is isolated by metal-to-metal static seals.

7. A method of using the subsurface safety valve system for a wellbore of claim 1, comprising:

dithering the electric power such that the electric power does not fall below the second electric power value.

8. A subsurface safety valve system for a wellbore comprising:

a tubular housing disposed within the wellbore wherein the tubular housing has a cavity running in a longitudinal direction therethrough;

a flow tube disposed within the housing, the flow tube containing a magnetic core;

a power spring coupled to the flow tube so as to bias the flow tube toward an upper end of the tubular housing;

an electromagnetic device offset in a longitudinal direction from the magnetic core, the electromagnetic device being configured to receive electric power to exert a magnetic force on a magnetic element toward a lower end of the tubular housing;

a coil chamber containing the electromagnetic device, wherein the coil chamber is pressure balanced with the cavity; and a flapper located within the tubular housing operative to open the cavity in response to displacement of the flow tube from a first position to a second position, wherein:

the flow tube is displaced from the first position to the second position in response to the electric power exceeding a first electric power value;

the flow tube remains displaced in the second position in response to the electric power exceeding a second electric power value; and the first electric power value is greater than the second electric power value, wherein the coil chamber is pressure balanced with an annulus surrounding the tubular housing.

9. The subsurface safety valve system for a wellbore of claim 8, further comprising:

a retention mechanism which engages the flow tube to the tubular housing in response to the flow tube being displaced in the second position.

10. The subsurface safety valve system for a wellbore of claim 9, wherein the retention mechanism comprises one or more retention balls configured to catch in a detent in the flow tube in response to the flow tube being displaced in the second position.

11. The subsurface safety valve system for a wellbore of claim 8, wherein the flapper is closed when the flow tube is in the first position.

12. The subsurface safety valve system for a wellbore of claim 8, wherein the electromagnetic device comprises a coil.

13. The subsurface safety valve system for a wellbore of claim 8, wherein the electromagnetic device comprises a plurality of coils.

14. The subsurface safety valve system for a wellbore of claim 8, wherein the electromagnetic device is in fluid isolation from the wellbore in the coil chamber.

15. The subsurface safety valve system for a wellbore of claim 14, wherein the electromagnetic device is isolated by metal-to-metal static seals.

16. A method of using the subsurface safety valve system for a wellbore of claim 8, comprising:

dithering the electric power such that the electric power does not exceed the first electric power value.

17. A method of using the subsurface safety valve system for a wellbore of claim 8, comprising:

electrically vibrating the flow tube relative to the tubular housing.

18. The method of claim 17, wherein the flow tube is electrically vibrated with respect to the surrounding tubular housing while the flow tube is stuck in an open position to allow the cavity to be closed.

19. The method of claim 18, wherein the flow tube is electrically vibrated with respect to the surrounding tubular housing while the flow tube is stuck in an closed position to allow the cavity to be opened.

* * * * *